US008382541B1

(12) United States Patent
Campbell

(10) Patent No.: US 8,382,541 B1
(45) Date of Patent: Feb. 26, 2013

(54) REVERSIBLE LIFE RAFT SYSTEM

(75) Inventor: Ryan Campbell, Lake Suzy, FL (US)

(73) Assignee: Winslow Marine Products Corporation, Lake Suzy, FL (US)

( * ) Notice: Subject to any disclaimer, the term of this patent is extended or adjusted under 35 U.S.C. 154(b) by 127 days.

(21) Appl. No.: 12/932,206

(22) Filed: Feb. 18, 2011

Related U.S. Application Data

(60) Provisional application No. 61/338,518, filed on Feb. 19, 2010.

(51) Int. Cl.
*B63B 35/58* (2006.01)

(52) U.S. Cl. ..... 441/38; 441/40; 114/349

(58) Field of Classification Search ..... 441/38, 441/40; 114/348, 349
See application file for complete search history.

(56) References Cited

U.S. PATENT DOCUMENTS

| | | | | |
|---|---|---|---|---|
| 6,206,743 | B1 * | 3/2001 | Martin | 441/37 |
| 6,375,529 | B1 * | 4/2002 | Infante et al. | 441/38 |
| 6,623,322 | B1 * | 9/2003 | Lesniak | 441/38 |
| 6,685,520 | B1 * | 2/2004 | Wiggins | 441/40 |
| 6,709,305 | B2 * | 3/2004 | Parrott et al. | 441/40 |

* cited by examiner

*Primary Examiner* — Stephen Avila
(74) *Attorney, Agent, or Firm* — Jerry J. Holden; John D. Titus

(57) ABSTRACT

An upper smart arch extends upwardly from an inflatable upper tube and a lower smart arch extends downwardly from a lower inflatable. An orientation sensing transfer valve is located at each interface of the upper smart arch and upper tube and a lower orientation sensing transfer valve is located at each interface between the lower smart arch and the lower tube. Deployment of the upper smart arch along with an upper canopy will be deployed with the opening of the upper orientation sensing transfer valve and the lower smart arch and a lower canopy will not be deployed since the lower orientation sensing transfer valve remains closed.

6 Claims, 5 Drawing Sheets

REVERSIBLE LIFE RAFT SYSTEM

RELATED APPLICATION

The present application is based upon the provisional patent application Ser. No. 61/338,518 filed on Feb. 19, 2010, the subject matter of which is incorporated herein by reference.

BACKGROUND OF THE INVENTION

1. Field of the Invention

The present invention relates to a reversible life raft system and is more particularly designed for use during over-water emergencies in a safe, convenient, reliable and economic manner regardless of the orientation in which it is deployed on water.

2. Description of the Prior Art

The use of life raft systems of known designs and configurations is known in the prior art. More specifically, life raft systems of known designs and configurations previously devised and utilized for use during over-water emergencies are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,375,529 issued Apr. 23, 2002 to Infante, et al. concerns a Reversible Life Raft and Method Therefor.

While this device and other similar devices fulfill their respective, particular objectives and requirements, the aforementioned patent does not describe a reversible life raft system that allows for use during over-water emergencies in a safe, convenient, reliable and economic manner regardless of the orientation in which it is deployed on water.

In this respect, the reversible life raft system according to the present invention substantially departs from the conventional concepts and designs of the prior art, and in doing so provides an apparatus primarily developed for use during over-water emergencies in a safe, convenient, reliable and economic manner regardless of the orientation in which it is deployed on water Therefore, it can be appreciated that there exists a continuing need for a new and improved reversible life raft system which can be used during over-water emergencies in a safe, convenient, reliable and economic manner regardless of the orientation in which it is deployed on water. In this regard, the present invention substantially fulfills this need.

SUMMARY OF THE INVENTION

In view of the foregoing disadvantages inherent in the known types of life raft systems of known designs and configurations now present in the prior art, the present invention provides an improved reversible life raft system. As such, the general purpose of the present invention, which will be described subsequently in greater detail, is to provide a new and improved reversible life raft system and method which has all the advantages of the prior art and none of the disadvantages.

To attain this, the present invention essentially comprises a reversible life raft system. First provided are two similarly configured buoyancy tubes. The buoyancy tubes include a first tube and a second tube. The tubes are mounted one above the other. Each tube is independently capable of supporting the overload capacity of the life raft system.

Next provided are two similarly configured automatic inflating tripod smart arches. The smart arches include a first smart arch and a second smart arch. The first and second smart arches are coupled to the first and second buoyancy tubes respectively. A first self-erecting canopy and a second self-erecting canopy are coupled to the first and second smart arches respectively. Only one smart arch located on the boarding side of tubes is adapted to inflate during deployment.

Orientation sensing transfer valves are provided. One orientation sensing transfer valve is incorporated on each smart arch. Each orientation sensing transfer valve having an interior canal with an upper end and a lower end, inlet holes, an interior ball-bearing and an interior orifice. When an orientation sensing transfer valve is in an upright position the interior ball-bearing rests on the lower end of the canal allowing the flow of air. When an orientation sensing transfer valve is in an inverse position the interior ball-bearing rests on the upper end of the canal obstructing the flow of air. Each orientation sensing transfer valve is adapted to isolate each smart arch from its associated tube in the unlikely event of a tube failure. Each orientation sensing transfer valve is also adapted to prevent a submerged smart arch from inflating.

A single cylinder valve assembly is next provided. The cylinder valve assembly is adapted to inflate both tubes and smart arches. The orientation sensing transfer valves allow the tubes to be inflated first to a pressure of 1 PSI before the smart arches are inflated. Once a single smart arch is inflated the tubes are inflated to a full capacity.

Next provided is a cylinder filled with nitrogen gas under pressure is coupled to the tubes and is adapted for use in deploying the system. The cylinder is adapted to contain various amounts of gas and, therefore, have numerous weight capacities based upon the capacity of the tubes.

Pressure relief valves are provided. One pressure relieve valve is installed on each tube to prevent over-pressurization due to over-inflation and temperature fluctuations.

Next provided are two inflatable components. Each inflatable component is formed of one of the tubes and an associated smart arch. Each inflatable component has a manual inflation valve adapted to permit manual inflation in the event of a pressure loss resulting from temperature variations and leakage.

Each canopy is adapted to be opened in two different positions. One position is a "Sail" position and the other position is a "Convertible" position. Each canopy is also adapted to be completely closed to keep water out of the inflatable components. The inflatable components are adapted to be inflated with the canopy completely stowed in "Stowed" position.

Six ballast bags are provided. The ballast bags are installed on the tubes to increase stability. Each ballast bag is adapted to provide approximately 65 pounds of ballast, plus or minus 10 percent, at 39 degrees Fahrenheit in fresh water. The effectiveness of each ballast bag is increased due to the submerged smart arches that are not inflated.

Next provided are two boarding ladders. One boarding ladder is located at a main entrance and one boarding ladder is located at a rear of the inflatable components. The boarding ladders are adapted to provide for entering the inflatable components from the water. Interior assist ladders and handles are provided and are adapted to provide additional assistance in boarding.

Raft knives are next provided. The raft knives are at the main entrance of the system and are attached to the tubes to prevent loss. The knives are adapted to be used to cut the mooring line for emergency release and for opening items from kits.

Next provided is a self-deploying sea anchor. The sea anchor is located at the rear of the inflatable components and is adapted to be used to reduce drift and assist in stabilizing the tubes in heavy seas.

Heaving-trailing lines with floating handles are next provided. The heaving-trailing lines are attached to the inflatable components to aid in pulling survivors to the tubes.

Next provided is one water activated survivor locator light installed on top of each smart arch to assist survivors and rescuers in locating the tubes at night. One water activated survivor locator light is mounted on the interior of the smart arches.

Prior to packaging, each system is vacuum sealed. The systems are then adapted to be packed in a soft valise or in a hard canister at the discretion of the customer.

Lastly, various placards are provided throughout the inflatable components and on the packaging. The placards are adapted to provide information such as instructions, warnings, and part identification. The placards are identical regardless of orientation of the inflatable components.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved reversible life raft system which has all of the advantages of the prior art life raft systems of known designs and configurations and none of the disadvantages.

It is another object of the present invention to provide a new and improved reversible life raft system which may be easily and efficiently manufactured and marketed.

It is further object of the present invention to provide a new and improved reversible life raft system which is of durable and reliable constructions.

An even further object of the present invention is to provide a new and improved reversible life raft system which is susceptible of a low cost of manufacture with regard to both materials and labor, and which accordingly is then susceptible of low prices of sale to the consuming public, thereby making such reversible life raft system economically available to the buying public.

Even still another object of the present invention is to provide a reversible life raft system use during over-water emergencies in a safe, convenient, reliable and economic manner regardless of the orientation in which it is deployed on water.

Lastly, it is an object of the present invention to provide a new and improved reversible life raft system having an upper smart arch extending upwardly from an inflatable upper tube and a lower smart arch extending downwardly from a lower inflatable. One orientation sensing transfer valve is located at an interface of the upper smart arch and upper tube and one lower orientation sensing transfer valve is located at an interface between the lower smart arch and the lower tube. Deployment of the upper smart arch along with an upper canopy will be deployed with the opening of the upper orientation sensing transfer valve and the lower smart arch and a lower canopy will not be deployed since the lower orientation sensing transfer valve remains closed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated and described the primary and preferred embodiment of the instant invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
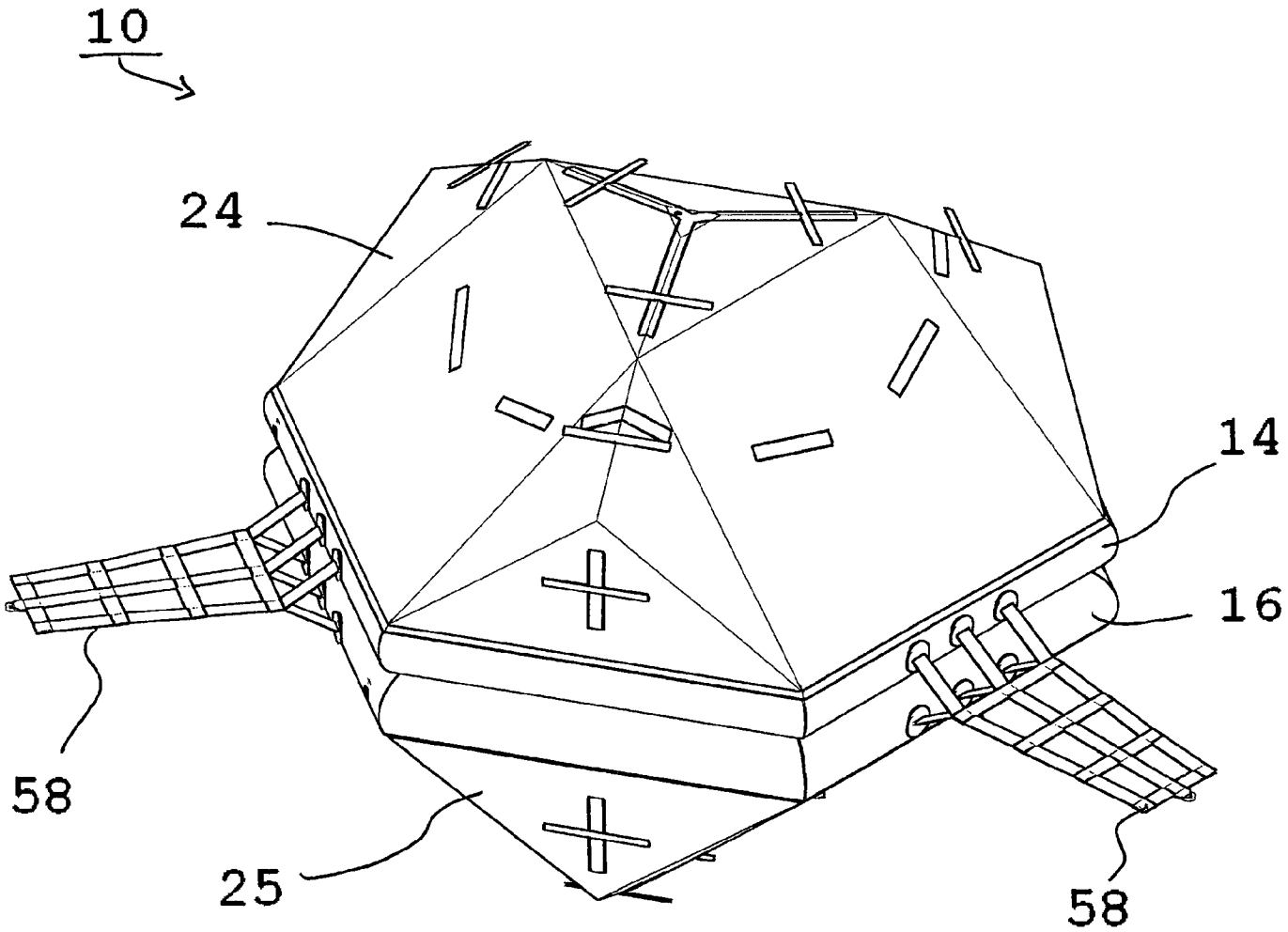
FIG. 1 is a perspective view of the reversible life raft system constructed in accordance with the principles of the present invention, the life raft system being with both canopies deployed.
Figure 2:
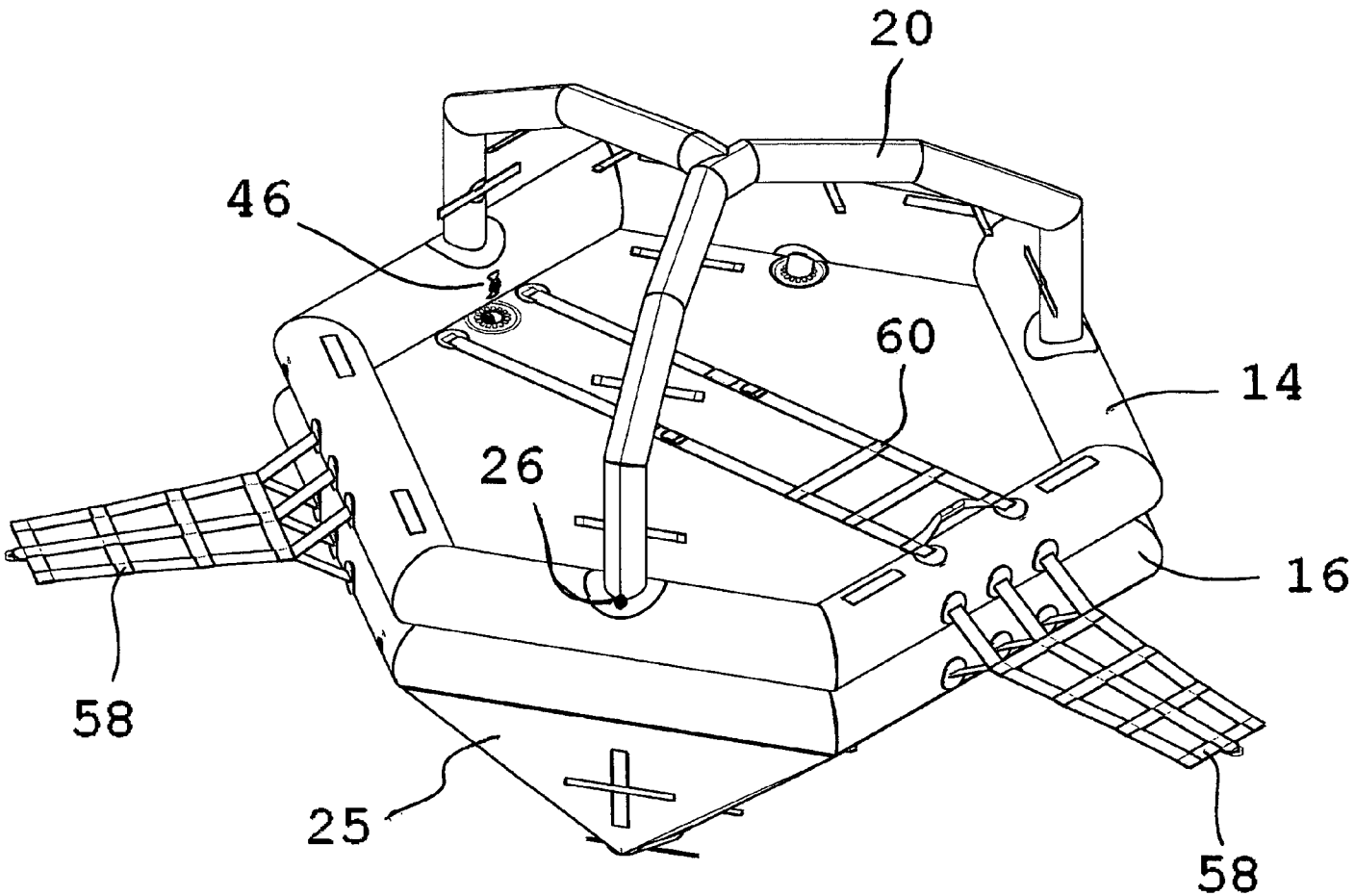
FIG. 2 is a perspective view, similar to FIG. 1, but without an upper canopy deployed.
Figure 3:
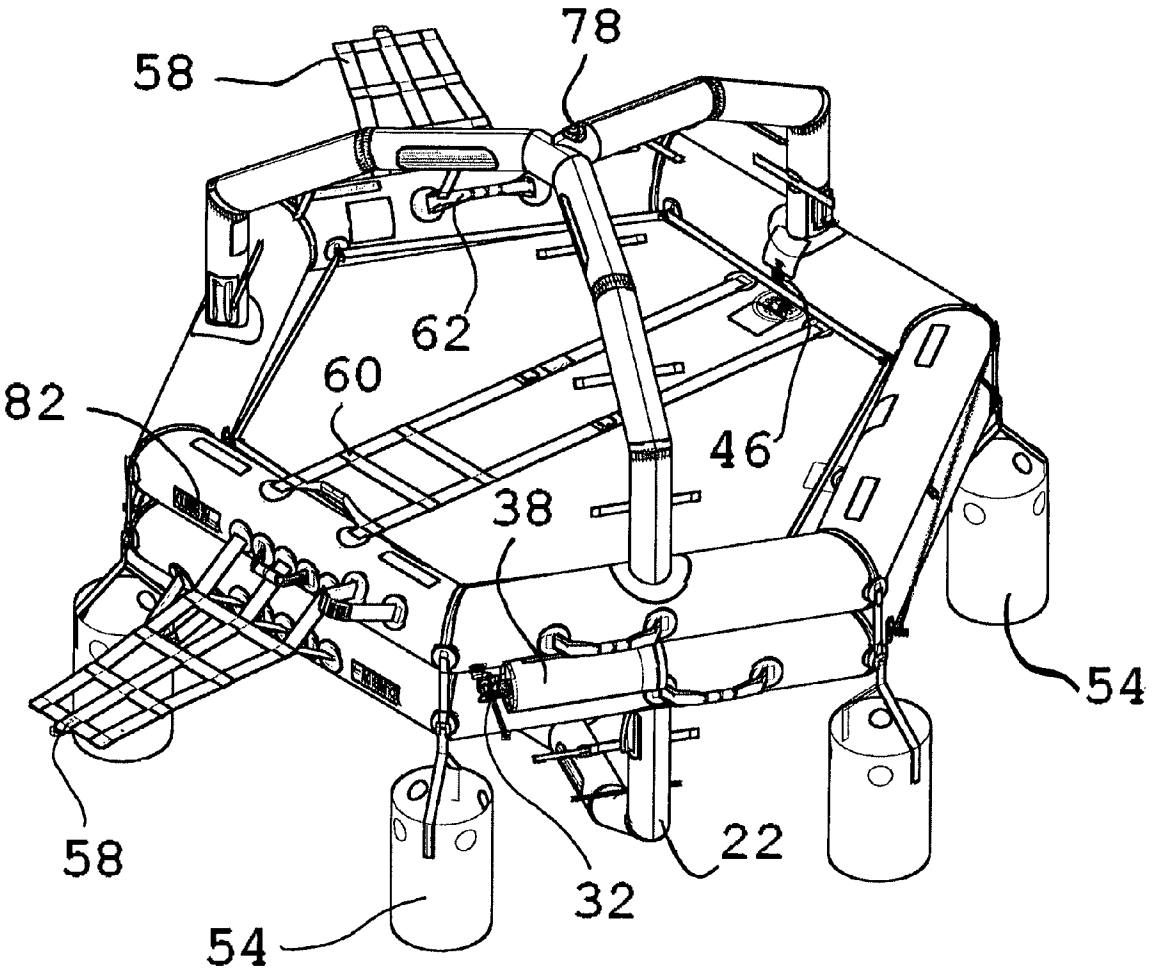
FIG. 3 is a perspective view, similar to FIG. 1, but without canopies.
Figure 4:
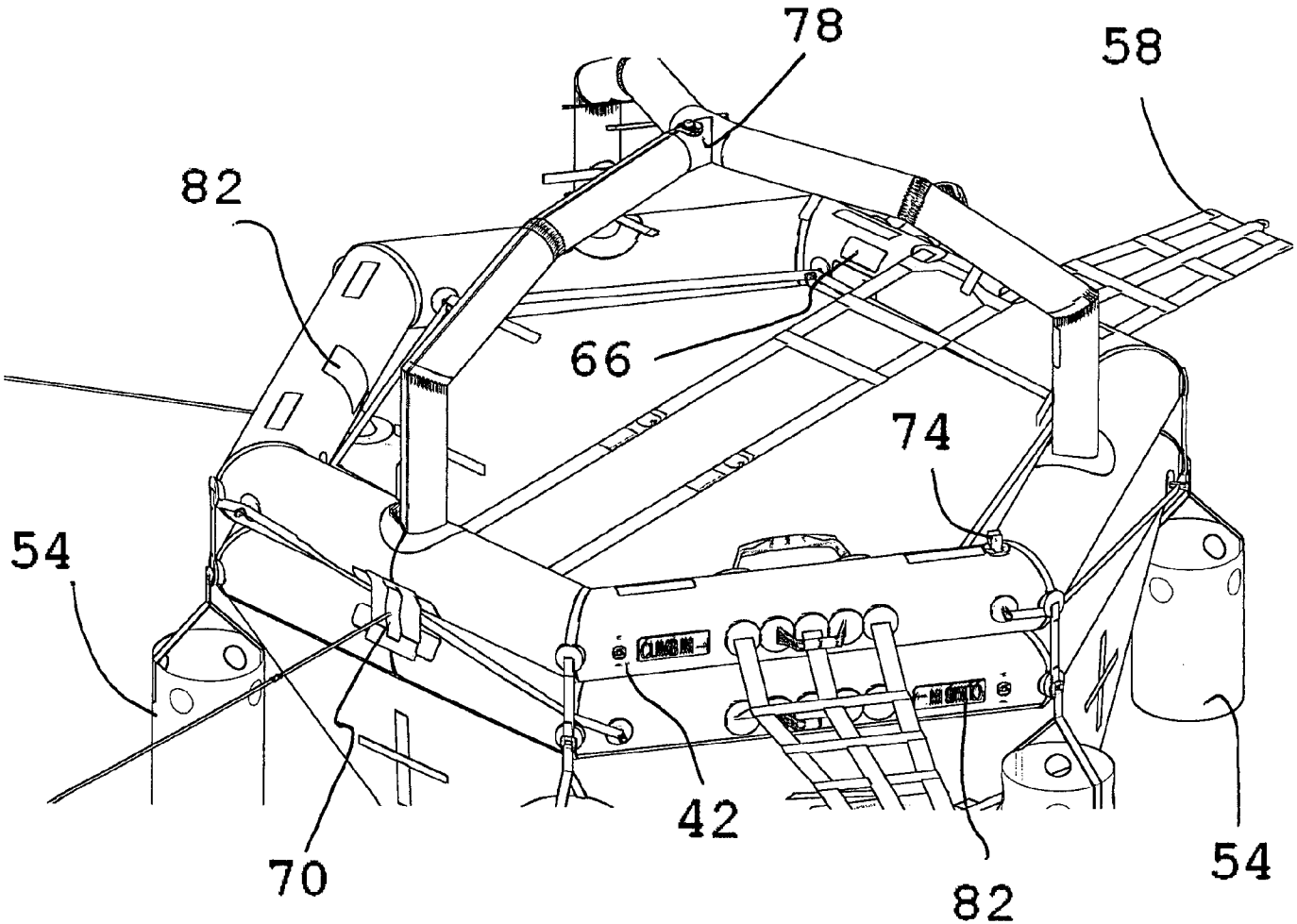
FIG. 4 is a perspective view, similar to FIG. 1, but without canopies and also illustrating a different angle of the system.
Figure 5:
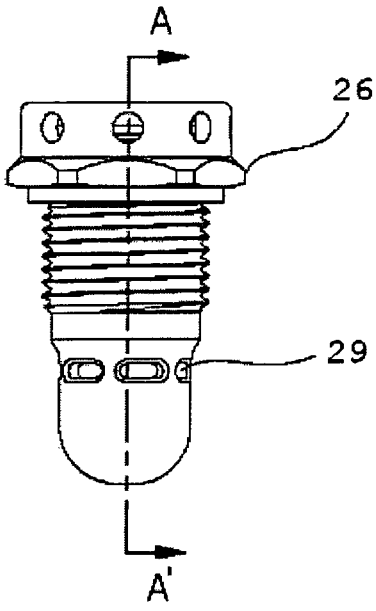
FIG. 5 is front elevational view of one of the orientation sensing transfer valves.
Figure 6:
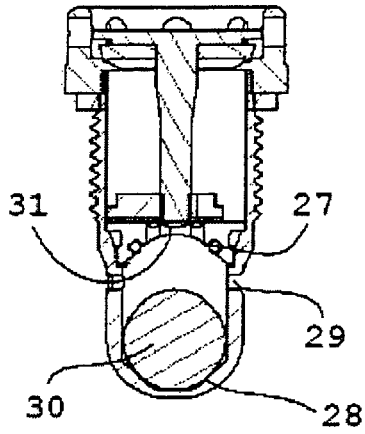
FIG. 6 is a cross section along line A-A' from FIG. 5 illustrating the orientation sensing transfer valve in an upright position.
Figure 7:
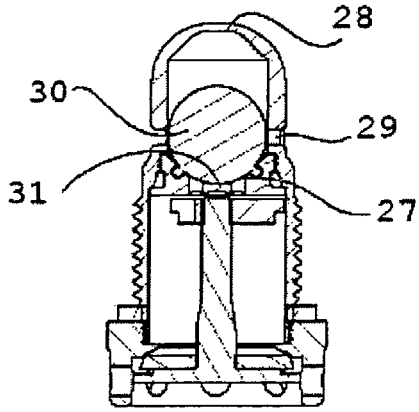
FIG. 7 is a cross section along line A-A' from FIG. 5 illustrating the orientation sensing transfer valve in an inverted position.

With reference now to the drawings, and in particular to FIG. 1 thereof, the preferred embodiment of the new and improved reversible life raft system embodying the principles and concepts of the present invention and generally designated by the reference numeral 10 will be described.

The present invention, the reversible life raft system 10 is comprised of a plurality of components. Such components in their broadest context include upper and lower inflatable tubes, upper and lower smart arches, and an orientation sensing transfer valve. Such components are individually configured and correlated with respect to each other so as to attain the desired objective.

First provided are two similarly configured buoyancy tubes. The buoyancy tubes include a first tube 14 and a second tube 16. The tubes are mounted one above the other. Each tube is independently capable of supporting the overload capacity of the life raft system.

Next provided are two similarly configured automatic inflating tripod smart arches. The smart arches include a first smart arch 20 and a second smart arch 22. The first and second smart arches are coupled to the first and second buoyancy tubes respectively. A first self-erecting canopy 24 and a second self-erecting canopy 25 are coupled to the first and second smart arches respectively. Only one smart arch located on the boarding side of tubes is adapted to inflate during deployment.

Orientation sensing transfer valves 26 are next provided. One orientation sensing transfer valve is incorporated on each smart arch. Each orientation sensing transfer valve having an interior canal with an upper end 27 and a lower end 28, inlet holes 29, an interior ball-bearing 30 and an interior orifice 31. When an orientation sensing transfer valve is in an upright position the interior ball-bearing rests on the lower end of the canal allowing the flow of air. When an orientation sensing transfer valve is in an inverse position the interior ball-bearing rests on the upper end of the canal obstructing the flow of air. Each orientation sensing transfer valve is adapted to isolate each smart arch from its associated tube in the unlikely event of a tube failure. Each orientation sensing transfer valve is also adapted to prevent a submerged smart arch from inflating.

A single cylinder valve assembly 32 is next provided. The cylinder valve assembly is adapted to inflate the tubes and smart arches. The orientation sensing transfer valves allow the tubes to be inflated first to a pressure of 1 PSI before the smart arches are inflated. Once each smart arch is inflated the tubes are inflated to a full capacity.

Next provided is a cylinder 38 filled with nitrogen gas under pressure is coupled to the tubes and is adapted for use in deploying the system. The cylinder is adapted to contain various amounts of gas and, therefore, have numerous weight capacities based upon the capacity of the tubes.

Pressure relief valves 42 are provided. One of the pressure relieve valves is installed on each tube to prevent over-pressurization due to over-inflation and temperature fluctuations.

Next provided are two inflatable components. Each inflatable component is formed of one of the tubes and an associated smart arch. Each inflatable component has a manual inflation valve 46 adapted to permit manual inflation in the event of a pressure loss resulting from temperature variations and leakage.

Each canopy is adapted to be opened in two different positions. One position is a "Sail" position and the other position is a "Convertible" position. Each canopy is also adapted to be completely closed to keep water out of the inflatable components. The inflatable components are adapted to be inflated with the canopy completely stowed in "Stowed" position.

Six ballast bags 54 are provided. The ballast bags are installed on the tubes to increase stability. Each ballast bag is adapted to provide approximately 65 pounds of ballast, plus or minus 10 percent, at 39 degrees Fahrenheit in fresh water. The effectiveness of each ballast bag is increased due to the submerged smart arches that are not inflated.

Next provided are two boarding ladders 58. One boarding ladder is located at a main entrance and one boarding ladder is located at a rear of the inflatable components. The boarding ladders are adapted to provide for entering the inflatable components from the water. Interior assist ladders 60 and handles 62 are provided and are adapted to provide additional assistance in boarding.

Raft knives 66 are next provided. The raft knives are at the main entrance of the system and are attached to the tubes to prevent loss. The knives are adapted to be used to cut the mooring line for emergency release and for opening items from kits.

Next provided is a self-deploying sea anchor 70. The sea anchor is located at the rear of the inflatable components and is adapted to be used to reduce drift and assist in stabilizing the tubes in heavy seas.

Heaving-trailing lines 74 with floating handles are next provided. The heaving-trailing lines are attached to the inflatable components to aid in pulling survivors to the tubes.

Next provided is one water activated survivor locator light 78 installed on top of each smart arch to assist survivors and rescuers in locating the tubes at night. One water activated survivor locator light is mounted on the interior of the smart arches.

Prior to packaging, each system is vacuum sealed. The systems are then adapted to be packed in a soft valise or a hard canister at the discretion of the customer.

Lastly, various placards 82 are provided throughout the inflatable components and on the packaging. The placards are adapted to provide information such as instructions, warnings, and part identification. The placards are identical regardless of orientation of the inflatable components.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A reversible life raft system including:

a source of inflation gas;

upper and lower tubes comprising inflatable tube members;

an upper smart arch extending upwardly from the upper tube;

a lower smart arch extending downwardly from the lower tube; and an upper orientation sensing transfer valve located at an interface of the upper smart arch and the upper tube and a lower orientation sensing transfer valve located at an interface between the lower smart arch and the lower tube, each of said upper and lower orientation sensing transfer valves including a valve element that opens to allow a flow of air when the orientation sensing transfer valve is upright and closes to block a flow of air when the orientation sensing transfer valve is inverted, whereupon as inflation gas flows from the source of inflation gas, the upper smart arch along with an upper canopy will be deployed since the upper orientation sensing transfer valve is upright and therefore remains open to allow a flow of inflation gas, and the lower smart arch and a lower canopy will not be deployed since the lower orientation sensing transfer valve is inverted and therefore remains closed to block a flow of inflation gas.

2. The system as set forth in claim 1, wherein:

the source of inflation gas comprises a cylinder coupled to the tubes and filled with nitrogen gas under pressure adapted for use in deploying the system, the cylinder adapted to contain various amounts of gas and therefore have numerous weight capacities based upon the capacity of the tubes.

3. The system as set forth in claim 1 and further including:

one pressure relief valve installed on each tube to prevent over-pressurization due to over-inflation and temperature fluctuations.

4. The system as set forth in claim 1 wherein:

the upper and lower orientation sensing transfer valves each comprise an interior canal with an upper end and a lower end, inlet holes, and an interior orifice and wherein the valve element comprises an interior ball-bearing, such that when the orientation sensing transfer valve is in an upright position the interior ball-bearing rests on the lower end of the canal allowing the flow of air, and wherein when the orientation sensing transfer valve is in an inverse position the interior ball-bearing rests on the upper end of the canal obstructing the flow of air, each orientation sensing transfer valve adapted to isolate each smart arch from its associated tube in the unlikely event of a tube failure, each orientation sensing transfer valve also adapted to prevent a submerged smart arch from inflating.

5. The system as set forth in claim 1 whereupon each inflatable component is formed of a tube and its associated smart arch, each inflatable component having a manual inflation valve adapted to permit manual inflation in the event of a pressure loss resulting from temperature variations or leakage.

6. A reversible life raft system (10) designed for use during over-water emergencies, the system adapted for use in a safe, convenient, reliable and economic manner regardless of the orientation in which it is deployed on water, the system comprising, in combination:

two similarly configured buoyancy tubes including a first tube (14) and a second tube (16), the tubes being mounted one above the other, each tube being independently capable of supporting the overload capacity of the life raft system;

two similarly configured automatic inflating tripod smart arches, including a first smart arch (20) and a second smart arch (22), the first and second smart arches coupled to the first and second buoyancy tubes respectively, on the life rafts, a first self-erecting canopy (24) and a second self-erecting canopy (25) coupled to the first and second smart arches respectively, only one smart arch located on the boarding side of the tubes adapted to inflate during deployment;

an orientation sensing transfer valve (26) incorporated in each smart arch, each orientation sensing transfer valve having an interior canal with an upper end (27) and a lower end (28), inlet holes (29), and interior ball-bearing (30) and an interior orifice (31), wherein when the orientation sensing transfer valve is in an upright position the interior ball-bearing rests on the lower end of the canal allowing the flow of air, and wherein when the orientation sensing transfer valve is in an inverse position the interior ball-bearing rests on the upper end of the canal obstructing the flow of air, each orientation sensing transfer valve adapted to isolate each smart art from its associated to in the unlikely event of a two failure, each orientation sensing transfer valve also adapted to prevent a submerged smart arch from inflating;

a single cylinder valve assembly (32) adapted to inflate those tubes and smart arches;

a cylinder (38) coupled to the tubes and filled with nitrogen gas under pressure adapted for use in deploying the system, the cylinder adapted to contain various amounts of gas and therefore have numerous weight capacities based upon the capacity of the tubes;

one pressure relief valve (42) installed on each tube to prevent over-pressurization due to over-inflation and temperature fluctuations; to inflatable components, each inflatable component being formed of one of the tubes and an associated smart arch, each inflatable component having a manual inflation valve (46) adapted to prevent manual inflation in the event of a pressure loss resulting from temperature variations and leakage;

each canopy adapted to be opened in two different positions, a "Sail" position and a "Convertible" position, each canopy also adapted to be completely closed to keep water out of the inflatable components, the inflatable components adapted to be inflated with the canopy completely stowed in "Stowed" position;

six ballast bags (54) installed on the tubes to increase stability, each ballast bag adapted to provide approximately 65 pounds of ballast, plus or minus 10 percent, at 39 degrees Fahrenheit in freshwater;

to boarding ladders (58), one located at the main entrance and one at a rear of the inflatable components, the boarding ladders being adapted to provide for entering the inflatable components from the water, interior cyst letters (60) and handles (62) adapted to provide additional assistance in boarding;

raft knives (66) provided at the main entrance of the system and attached to the tubes to prevent loss, the knives adapted to be used to cut the mooring line for emergency release and opening items from kits; a self-deploying sea anchor (70) located at the rear of the inflatable components adapted to be used to reduce drift and assist in stabilizing the tubes in heavy seas;

heaving-trailing lines (74) with floating handles attached to the inflatable components to aid in pulling survivors to the tubes;

one water activated survivor locator light (78) installed on top of each smart arch to assist survivors and rescuers in locating the tubes at night, one water activated survivor locator light being mounted on the interior of the smart arches;

prior to packaging, each system is vacuum sealed, systems are then adapted to be packed in a soft valise;

various placards (82) throughout the inflatable components and on the packaging, and such placards adapted to provide information such as instructions, warnings, and part identification, the placards being identical regardless of orientation of the inflatable components.

* * * * *